US005359746A

United States Patent [19]

Kane et al.

[11] Patent Number: 5,359,746

[45] Date of Patent: Nov. 1, 1994

[54] RAMP JUNCTION

[75] Inventors: Patrick R. Kane, Port Hueneme; Billie R. Karrh, Santa Paula; Kit Mack, Camarillo; Samuel J. Oppedisano, Ojai, all of Calif.

[73] Assignee: The United States of America as represented by the Secretary of the Navy, Washington, D.C.

[21] Appl. No.: 808,303

[22] Filed: Dec. 16, 1991

[51] Int. Cl.[5] ..... E01D 1/00; E02D 23/00

[52] U.S. Cl. ..... 14/711; 14/69.5

[58] Field of Search ..... 14/2.6, 27, 28, 37–38, 14/43, 56, 62, 71.1, 71.5

[56] References Cited

U.S. PATENT DOCUMENTS

| | | | |
|---|---|---|---|
| 2,759,207 | 8/1956 | Pennington | 14/69.5 |
| 3,397,546 | 3/1966 | Eisert et al. | 14/28 |
| 3,766,585 | 10/1973 | Yoon | 14/69.5 |
| 3,827,385 | 8/1974 | Soma | 14/71.1 |
| 3,881,206 | 5/1975 | Christensen | 14/69.5 |
| 4,076,134 | 2/1978 | Landow | 14/69.5 X |
| 4,107,932 | 8/1978 | Cantrell | 14/69.5 X |
| 4,242,032 | 12/1980 | Whiteman et al. | 14/71.1 X |
| 4,274,172 | 6/1981 | Franklin | 14/69.5 |
| 4,556,341 | 12/1985 | Ayers | 405/195 |
| 4,581,784 | 4/1986 | Rousseau et al. | 14/71.1 |
| 4,590,634 | 5/1986 | Williams | 14/27 X |
| 4,845,792 | 7/1989 | Bakula et al. | 14/71.1 X |
| 4,920,597 | 5/1990 | Hamilton | 14/69.5 |

*Primary Examiner*—Stephen C. Pellegrino
*Assistant Examiner*—Nancy Mulcare
*Attorney, Agent, or Firm*—Ron Billi; Melvin J. Sliwka; John L. Forrest, Jr.

[57] ABSTRACT

An apparatus for spanning the distance between a fixed first platform and a movable second platform includes a ramp; a first pivoting junction located between one end of the ramp and the fixed first platform, and a second sliding junction located between the other end of the ramp and the movable second platform. The first pivoting junction accommodates pitch, roll and heave motion between the fixed platform and the ramp and the second sliding junction accommodates elevation changes between the fixed platform and the movable platform. Means are provided to dampening the motion of the ramp. Other means are provided to limit the side to side movement of the ramp.

14 Claims, 3 Drawing Sheets

RAMP JUNCTION

BACKGROUND OF THE INVENTION

This invention relates generally to loading ramps. More specifically, but without limitation, this inventions relates to a ramp junction that allows a ramp to span the distance between a fixed platform and a floating platform where the fixed platform may be elevated above the floating platform.

There have been many ramps proposed that span the distance between two platforms. These platforms are usually some fixed distance apart and have top surfaces substantially parallel to each other. The platforms may be at the same or different elevations before, during or after the loading process. An example of such a device is shown in U.S. Pat. No. 2,759,207 wherein each inner end of two ramps is hinged to a common support structure. This device compensates for vertical misalignment of the platforms but does not compensate when the surfaces of the two platforms are not parallel. A special situation arises when a ramp must span the distance between a fixed platform and a floating platform. The ramp must not only be capable of compensating for the vertical misalignment due to tide elevation changes and cargo on/off loading but must also compensate for the continuous changes in misalignment due to the undulating surface of the sea upon which one platform floats. These changes are commonly referred to as pitch, roll and heave. The problem is compounded when the structures must be capable of handling very heavy loads, such as tanks, yet be easily and quickly assembled and disassembled in, for example, a battlefield environment.

Thus, there is a need in the art to provide a ramp with connecting junctions that attach a fixed upper platform to a floating lower platform and that can compensate for continuing changes in misalignment due to pitch, roll, heave and other movements and, at the same time, provide a secure, safe passageway for heavy vehicles such as a 130,000 lb. tank.

SUMMARY OF THE INVENTION

Accordingly, the preferred embodiment of the present invention includes a lightweight, modular spanning ramp with first and second ends, the first end pivotally communicating with a fixed, elevated platform and the second end slidably communicating with a lower, floating platform.

The pivotal connection between the first end of the ramp and the fixed elevated platform (upper junction) includes a kingpin, centrally attached to the bottom of the ramp, a kingpin receiver attached to the top of the platform and two rubber fenders located near the sides of the ramp. The kingpin assembly allows the ramp to accommodate pitch, roll and heave and the rubber fenders limit and dampen these motions. In addition, both sides of the ramp are attached, via links, to the platform to control uplifting of the ramp.

The slidable connection between the second end of the ramp and the lower floating platform (lower junction) includes a plurality of stainless steel skates attached to the bottom of the ramp and wax coated timber dunnage placed on the deck of the floating platform. The skates move with resistance on the waxed timber dunnage to accommodate changes in elevation but do not move in response to normal wave action or to changes in trim of the floating platform.

It is therefore an object of the present invention to provide an apparatus for safely and easily transporting vehicles, such as a tank, from an elevated fixed platform to a lower, floating platform.

It is another object of the present invention to provide an apparatus for safely and easily transporting vehicles from an elevated fixed platform to a lower floating platform that can accommodate the pitch, roll and heave encountered in a sea environment.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
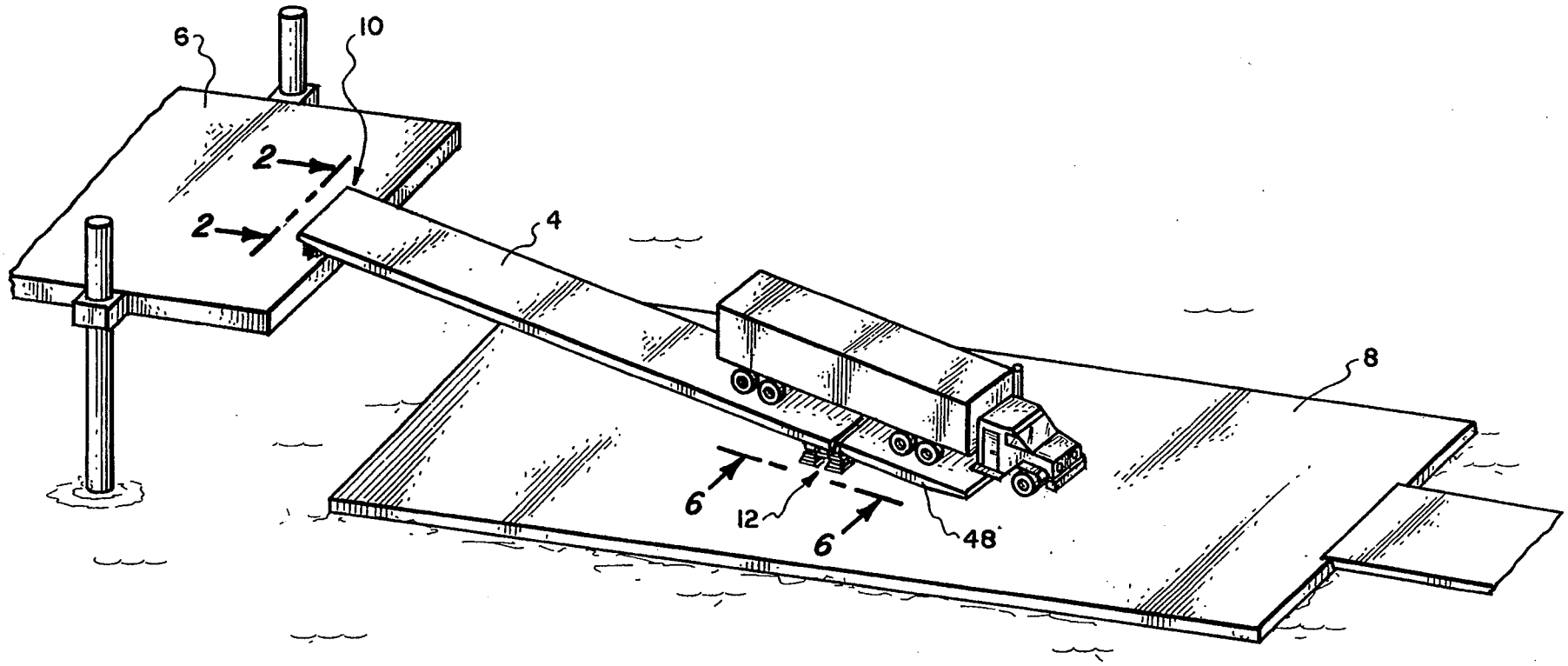
FIG. 1 is an illustration showing the ramp of the present invention communicating with a fixed, elevated platform on a first end and communicating with a floating, lower platform on a second end.

The preferred embodiment of the present invention is illustrated by way of example in FIGS. 1 to 7. As shown in FIG. 1, ramp 4 spans the distance between fixed, elevated platform 6 and floating, lower platform 8 and is of sufficient size and strength to support a heavy vehicle such as a 130,000 lb. tank. As can be seen floating, lower platform 8 is subject to wave, current, tide and other such undulations which are accommodated for by upper junction 10 and lower junction 12.

Figure 2:
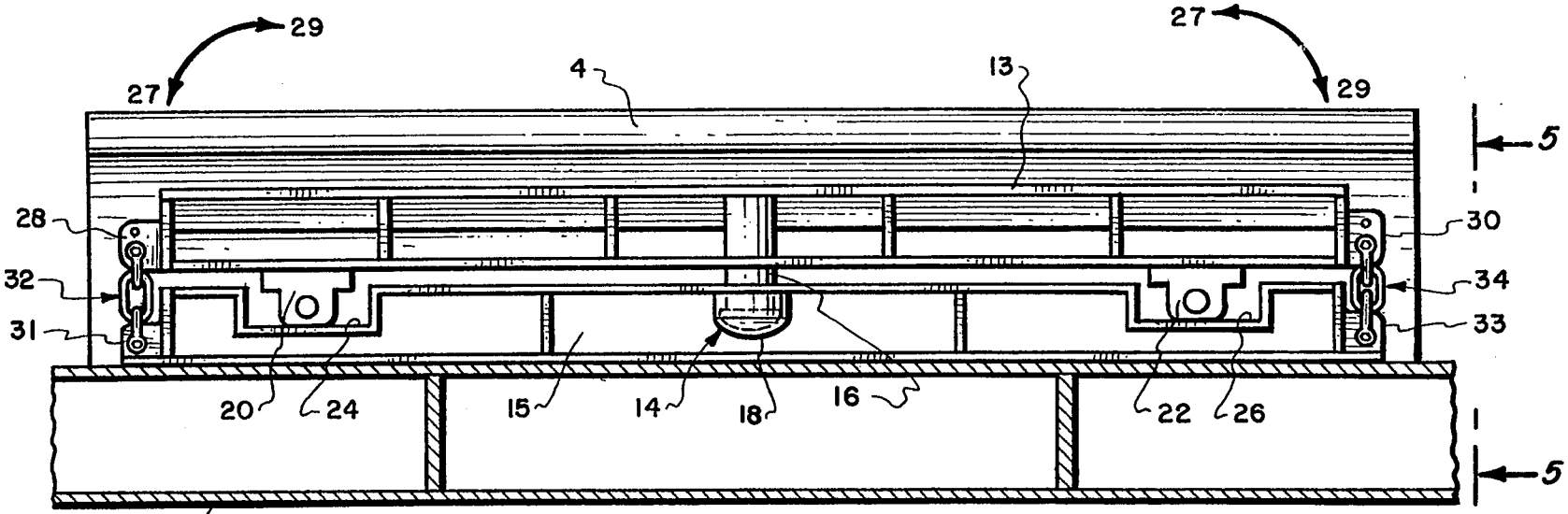
FIG. 2 is a cross section of the upper junction taken through Section 2—2 of FIG. 1.
Figure 5:
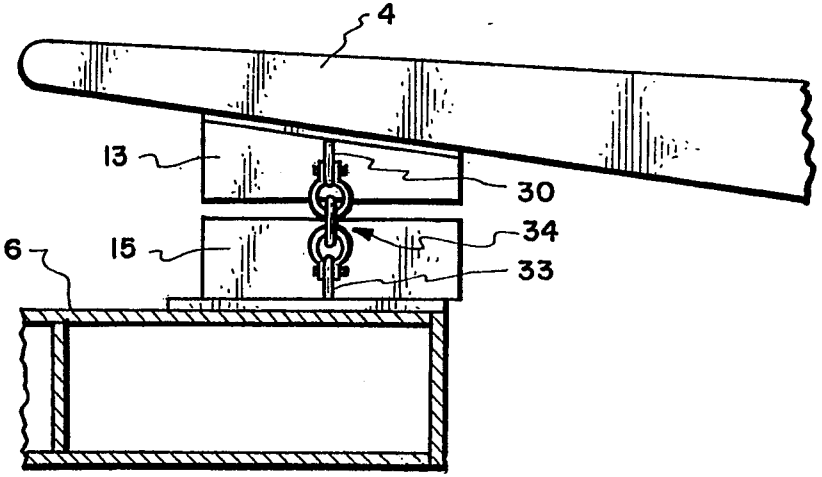
FIG. 5 is a side view of the upper junction taken through Section 5—5 of FIG. 2.

Upper junction 10, shown in FIG. 2, includes beam 13, kingpin assembly 14, rubber fenders 20 and 22, link assemblies 32 and 34 and beam 15. Kingpin assembly 14 includes kingpin 16 attached to beam 13 and kingpin receiver 18 attached to beam 15. Beam 13 attaches to the bottom of ramp 4 and is positioned so that kingpin 16 is located at the longitudinal centerline of ramp 4. Beam 15 is attached to elevated platform 6. In the preferred embodiment, kingpin 16 is fabricated from 6 inch diameter, extra strong steel pipe, schedule 80, ASTM A53 GR. B with a welded steel end cap, extra strong, ASTM A234. Kingpin 16 is attached, as by welding, to beam 13 and extends approximately 8½ inches from the bottom of beam 13. Kingpin receiver 18 is fabricated from 8 inch diameter, extra strong steel pipe, schedule 80, ASTM A53 GR.B with a welded steel end cap, extra strong, ASTM A234 and is approximately 7 inches deep.

Fenders 20 and 22 are attached to the bottom of beam 13, the centerline of each fender located approximately 5 feet on either side of the centerline of kingpin 16, as shown in FIG. 2. Fenders 20 and 22 are approximately 32 inches long, 8 inches high when uncompressed and include with a 4" inside diameter opening. In the preferred embodiment, fenders 20 and 22 conform to ASTM D-2000/SAEJ200: 3BA 720 A14, B13, D11, F17, L11 or 4CA 720 C32, F19, G11, L14, 2000 PSI minimum tensile strength, 70 durometer hardness. A suitable and preferred fender is available from Trellex Morse, 3588 Main Street, Keokuk, Iowa 52632 part No. F-8-1000. Openings 24 and 26 receive rubber fenders 20 and 22 respectively and are approximately 34 inches long, 18 inches wide and 5 inches deep. It should be noted that when kingpin 16 is installed in kingpin receiver 18, as shown in FIG. 2, fenders 20 and 22 are compressed approximately 1½ inches when the bottom of beam 13 is parallel to beam 15. Thus, it can be seen that ramp 4 may move about the axis of kingpin assembly 14 to accommodate roll, pitch, heave and other relative motion variations. The side-to-side rolling movement, shown as motion arrows 27 and 29 in FIG. 2, as well as other pivoting movements are damped by fenders 20 and 22. Fenders 20 and 22 also act to stabilize ramp 4.

Figure 4:
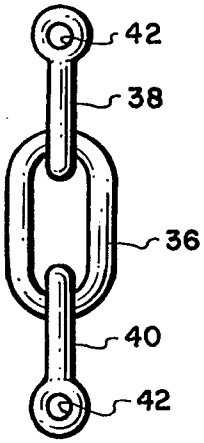
FIG. 4 is a side view of a link assembly in the extended position.
Figure 3:
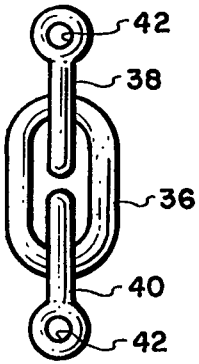
FIG. 3 is a side view of a link assembly in the installed position.

Link assembly 32 is attached on one end to ear 28 and on the other end to ear 31; similarly link assembly 34 is attached to ear 30 on one end and to ear 33 on the other end. A typical link assembly is shown in FIGS. 3 and 4, and includes center link 36 and end shackles 38 and 40 with bores 42.

When beam 13 is substantially parallel to beam 15, as shown in FIG. 2, link assemblies 32 and 34 do not offer any resistive tensile force. However, when ramp 4 (and beam 13) moves about kingpin assembly 14, for example in the direction of motion arrows 27, ear 30 will move away from ear 33 and link assembly 34 will elongate to the extended position as shown in FIG. 4. Link assembly 34 will then be fully elongated and prevent further movement in the direction of motion arrow 27. Similarly, link 32 will limit the movement of ramp 4 (and beam 13) in the direction of motion arrows 29. The distance between bores 42 when in the assembled position, as shown in FIG. 3, is 11 inches and the distance between bores 42 in the extended position, as shown in FIG. 4, is 13¾ inches. Thus, a movement of approximately 1¾ inches from the assembled position is necessary before link assemblies 32 and 34 exert a resistive tensile force.

It should be noted that beam 13 and/or beam 15 may, if desired, be eliminated. If beam 13 is eliminated kingpin 16, fenders 20 and 22 and link assemblies 32 and 34 may be attached directly to ramp 4. If beam 15 is eliminated, kingpin receiver 18 and openings 24 and 26 may be incorporated in platform 6. In addition, link assemblies 32 and 34 may be attached directly to platform 6.

Figure 6:
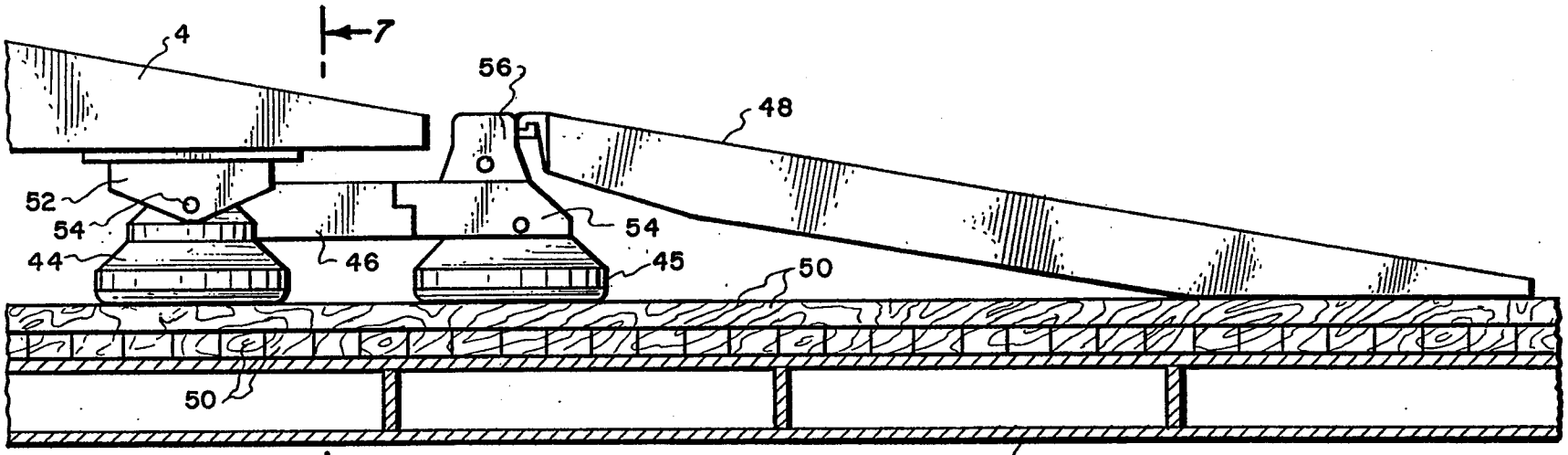
FIG. 6 is a side view of the lower junction taken through Section 6—6 of FIG. 1.
Figure 7:
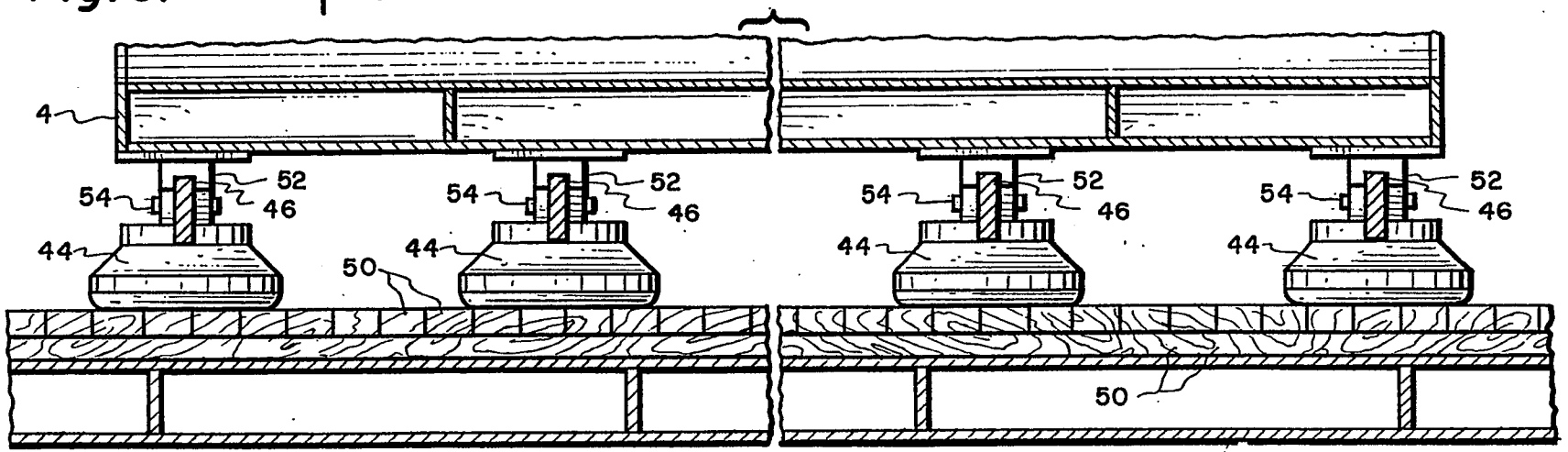
FIG. 7 is an end view of the lower junction taken through Section 7—7 of FIG. 6.

Lower junction 12, shown in FIG. 6 and 7, includes stainless steel skates 44 and 45, links 46 (only one shown) and finger ramp 48. Each skate 44 and 45 slides on wax coated timber dunnage 50 placed evenly in alternating layers on lower platform 8 as shown in FIGS. 6 and 7. The wax coating reduces friction between the bottom of skates 44 and 45, and the dunnage 50 so that the skates move with resistance but do not move in response to wave action or changes in trim of the lower platform. Four skates 44 are located under ramp 4 and are arranged and positioned as shown in FIG. 7. Four skates 45 are located partially under one end of finger ramp 48 and are arranged and positioned to support the end of finger ramp 48. Links 46 attached adjacent pairs of skates 44 to skates 45, as shown in FIG. 6. Each skate 44 is pivotally attached to mount 52 by pins 54. Each skate 45 is pivotally attached to mount 56 by pins 54. Mounts 56 are pivotally connected to one end of finger ramp 48. It should be noted that finger ramp 48 may be used at either end of ramp 4, as required.

Obviously many modifications and variations of the present invention are possible in light of the above teachings. It is therefore to be understood that within the scope of the appended claims, the invention may be practiced otherwise than as specifically described.

What is claimed is:

1. A ramp junction for connecting a ramp and a platform, the ramp having a bottom and the platform having a top, comprising:

a) an upper beam attached to the bottom of a ramp;

b) a lower beam attached to the top of a platform;

c) means for pivotally connecting the upper beam to the lower beam the pivotal connecting means capable of pivoting in all directions to accommodate roll, pitch, heave and other relative motions between a ramp and a platform;

d) means mounted on a ramp for dampening and stabilizing the movement of a ramp relative to a platform;

e) means mounted on a ramp for limiting the movement of a ramp relative to a platform.

2. The apparatus defined in claim 1, wherein the pivotal connecting means includes a kingpin with first and second ends and a kingpin receiver, the first end of the kingpin attached to and depending from said upper beam and the kingpin receiver located in said lower beam, the second end of said kingpin and said kingpin receiver communicating to allow relative movement between a ramp and a platform.

3. The apparatus defined in claim 2, wherein the dampening and stabilizing means includes first and second fenders positioned on each side of said kingpin to dampen and stabilize the movement of a ramp relative to a platform.

4. The apparatus defined in claim 3, wherein the limiting means includes first and second link assemblies, the first link assembly enablingly attached between a ramp and a platform on one side of said kingpin to limit the rolling movement of a ramp in one direction and the second link assembly enablingly attached between a ramp and a platform on the other side of said kingpin to limit the rolling movement of a ramp in the other direction.

5. The apparatus defined in claim 4, wherein said dampening and stabilizing means includes openings located in said lower beam, the openings positioned for receiving the fenders.

6. The apparatus defined in claim 5, wherein each said link assembly includes a center link and two end shackles.

7. An apparatus for spanning the distance between a first platform and a second platform comprising:

a) a ramp with first and second ends;

b) means for pivotally connecting the first end of the ramp to a first platform, the pivotal connecting means capable of pivoting in all directions to accommodate roll, pitch, heave and other relative motions between said ramp and a first platform;

c) means mounted on said ramp for dampening and stabilizing the movement of said ramp relative to a first platform;

d) means mounted on said ramp for limiting the rolling movement of said ramp relative to a first platform;

e) means for slidably connecting the second end of said ramp to a second platform.

8. The apparatus defined in claim 7, wherein the ramp has a bottom and the pivotal connecting means includes a kingpin with first and second ends and a kingpin receiver, the kingpin receiver attached to a first platform and the first end of the kingpin attached to and depending from the bottom of said ramp, said kingpin receiver and the second end of said kingpin communicating to allow pivoting movement in all directions to accommodate roll, pitch, heave and other relative motions between said ramp and a first platform.

9. The apparatus defined in claim 8, wherein the dampening and stabilizing means includes first and second fenders positioned on each side of said kingpin to dampen and stabilize the movement of said ramp relative to a first platform.

10. The apparatus defined in claim 9, wherein the limiting means includes first and second link assemblies, the first link assembly enablingly attached between said first end of said ramp and a first platform on one side of said kingpin to limit the rolling movement of said ramp in one direction and the second link assembly enablingly attached between said first end of said ramp and a first platform on the other side of said kingpin to limit the rolling movement of said ramp in the other direction.

11. The apparatus defined in claim 10, wherein said dampening and stabilizing means includes openings located in a first platform positioned for receiving the fenders.

12. The apparatus defined in claim 11, wherein each said link assembly includes a center link and two end shackles.

13. The apparatus defined in claim 12, wherein the slidable connecting means includes one or more skates attached to the bottom of said ramp at said second end of said ramp, the skates slidably communicating with a second platform, in such a way as to accommodate elevation changes between a first and a said platform.

14. The apparatus defined in claim 13, further including wax coated timber dunnage located between said skates and a second platform so as to allow said skates to slide on said timber dunnage with resistance.

* * * * *